US005942963A

United States Patent [19]

Reznik et al.

[11] Patent Number: 5,942,963

[45] Date of Patent: Aug. 24, 1999

[54] MULTIWOUND COIL EMBEDDED IN CERAMIC

[75] Inventors: Svetlana Reznik; Dilip K. Chatterjee, both of Rochester; Edward P. Furlani, Lancaster, all of N.Y.

[73] Assignee: Eastman Kodak Company, Rochester, N.Y.

[21] Appl. No.: 08/932,472

[22] Filed: Sep. 18, 1997

[51] Int. Cl.[6] ..... H01F 7/06; H01F 27/02

[52] U.S. Cl. ..... 336/83; 29/602.1; 29/606; 336/96; 336/92

[58] Field of Search ..... 336/83, 90, 92, 336/96; 29/602.1, 605, 606

[56] References Cited

U.S. PATENT DOCUMENTS

| | | | |
|---|---|---|---|
| 5,294,749 | 3/1994 | Lauder et al. | 336/96 |
| 5,597,644 | 1/1997 | Araki et al. | 428/210 |
| 5,683,649 | 11/1997 | Chattejee et al. | 264/619 |

FOREIGN PATENT DOCUMENTS

| | | | |
|---|---|---|---|
| 52-40728 | 3/1977 | Japan | 336/90 |
| 60-163411 | 8/1985 | Japan | 336/190 |
| 1165613 | 10/1969 | United Kingdom | 336/90 |

*Primary Examiner*—Lincoln Donovan
*Assistant Examiner*—Anh Mai
*Attorney, Agent, or Firm*—Raymond L. Owens

[57] ABSTRACT

A ceramic device having an embedded multiwound coil and a method of making such device is disclosed. The device includes a ceramic unitary structure having at least two sintered ceramic parts, each of which when aligned forms a cavity and two spaced apart outlet holes connected to different portions of the cavity; a sintered ceramic conduit provided in the trough of the ceramic unitary structure and having an inner passageway with such sintered ceramic conduit forming a coil structure; and an embedded multi-wound coil formed in the inner passageway of an electrically conductive material.

5 Claims, 4 Drawing Sheets

MULTIWOUND COIL EMBEDDED IN CERAMIC

FIELD OF THE INVENTION

This invention relates to structures for aligning magnetic particles in a viscous binder.

BACKGROUND OF THE INVENTION

Magnetic films are used in numerous applications involving data storage and retrieval. For example, such films are used to store account information on credit cards. One method for producing magnetic films is by extrusion. In this method, magnetic particles are dispersed in a viscous binder, and then extruded in the form of a film. However, if the magnetic particles are made from an anisotropic material such as barium ferrite which has a preferred axis of magnetization, they must have their preferred magnetic axis aligned in the binder while it is viscous (prior to hardening) to enhance the recording performance of the film. The alignment of such particles entails the application of an external magnetic field that couples to the particles and rotates them in the viscous binder until their preferred axis of magnetization aligns with the external field. The alignment field is usually produced by an energized coil of standard gauge copper wire. For the mass fabrication of magnetic film, the coil must carry a high current (30 amps) on a continual basis. Moreover, if the film is extruded, the coil is exposed to high temperatures on the order of 500° F. due to its close proximity to the extrusion apparatus. Under these conditions, conventional coils overheat and degrade requiring costly and time consuming maintenance and replacement. Therefore, a need exists for a coil that can carry a high current and operate continually in a high temperature environment without degradation.

SUMMARY OF THE INVENTION

It is an object of the present invention to provide an alignment coil for use in aligning magnetic particles provided in a viscous binder.

This object is achieved in a method for forming a ceramic device having an embedded multiwound coil which is adapted for use in aligning magnetic particles provided in a viscous binder prior to hardening of such binder, comprising the steps of:

(a) providing at least two molded ceramic parts in the green state, each of which is formed with a trough and two spaced apart outlet recesses connected to different portions of the trough;

(b) providing through holes in each of the two molded ceramic parts;

(c) placing a green state ceramic conduit structure having an inner passageway into the trough of one of the molded ceramic parts with such conduit structure forming a coil structure;

(d) aligning the two molded ceramic parts to form a assembled coil receiving structure in which the troughs are aligned to encompass the conduit structure and the through holes are aligned to provide a passage for the viscous binder through the ceramic device;

(e) sintering the assembled coil receiving structure to form a unitary ceramic structure with an internal passageway in the form of the inner passage way of the green state ceramic conduit; and (f) filling the internal passageway of the unitary ceramic structure with an electrically conductive material to provide the embedded multiwound coil.

The present invention has the following advantages:

In accordance with the present invention a coil which is embedded in a sintered unitary ceramic structure are able to operate without degradation in high temperature and corrosive environments.

Another advantage of the present invention is that a coil embedded in the unitary ceramic structure can be formed without utilization of any etching process.

Still another advantage of the present invention is that the embedded coil and encapsulating ceramic structure can be produced in any shape.

A further advantage is because of the poor thermal conductivity of the ceramic material, the heat generated in the alignment coil is contained in the coil region.

These and other aspects, objects, features, and advantages of the present invention will be more clearly understood and appreciated from a review of the following detailed description of the preferred embodiment and appended claims, and by reference to the accompanying drawings.

DETAILED DESCRIPTION OF THE INVENTION

The method of the present invention will be described in conjunction with the fabrication of a specific ceramic device having an embedded multiwound coil. This is by way of example only in that the teachings of the present method can be used to fabricate a wide range of such devices.

Figure 1:
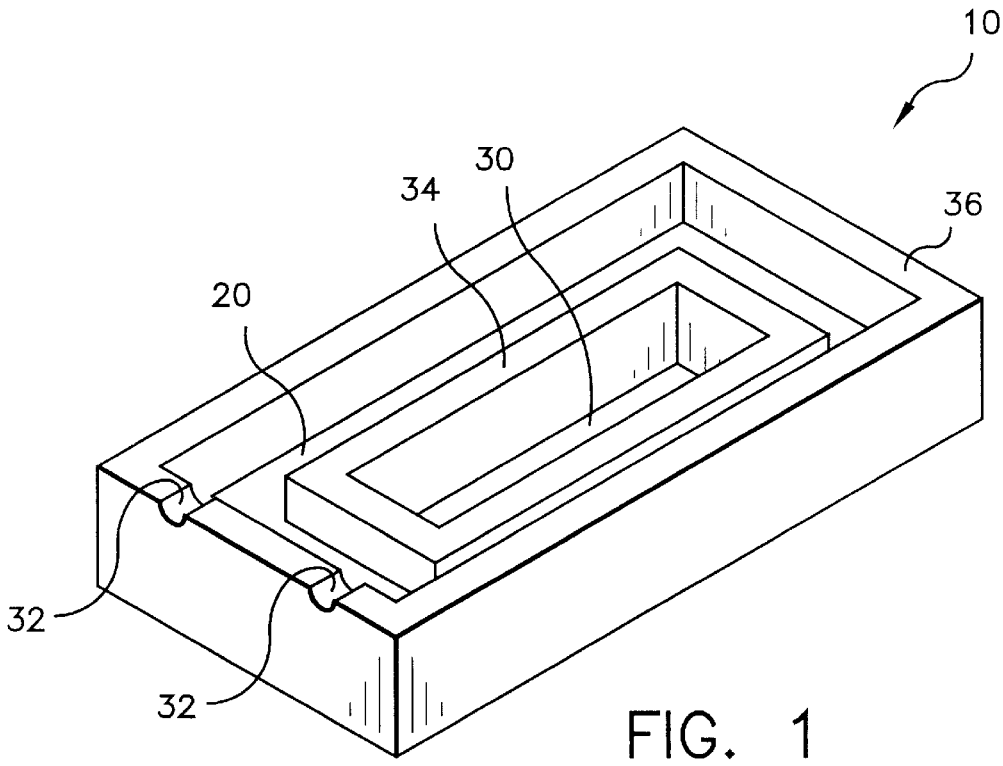
FIG. 1 is a perspective of molded ceramic part.

Referring to FIG. 1, a perspective is shown of a molded ceramic part 10 in the green state. The molded ceramic part 10 comprises a trough 20, through-hole 30, inner and outer ridges 34 and 36, respectively, and outlet recesses 32. The molded ceramic part 10 is designed to be large enough to compensate for the approximately 15 to 22% shrinkage of the molded ceramic part 10 which occurs during the sintering process. The use of the term "green" means that particulate ceramic powder, preferably mixed with an organic binder is subjected to uniform compacting forces in order to provide an unsintered preform which has uniform density. The molded ceramic part 10 can be molded by standard methods such as injection molding, gel casting, tape casting, dry pressing or cold isostatic pressing in conjunction with green machining. The molded ceramic part 10 is made from thermally insulating ceramics and its composites which include $ZrO_2$, $Al_2O_3$, BN, MgO, $TiO_2$, $ZrO_2$—$Al_2O_3$ and $Al_2O_3$—$ZrO_2$. In particular, zirconia ($ZrO_2$) alloy is an excellent choice of ceramic material for manufacturing the molded ceramic part 10. It has very poor thermal conductivity with high fracture toughness, corrosion resistance, wear and abrasion resistance. Specific examples of ceramics useful for this invention include: tetragonal structure zirconia alloy having form about 2 to about 5 mol % $Y_2O_3$ or more preferably about 3 mol % $Y_2O_3$.

A specific example of a manufacturing process for the fabrication of molded ceramic part 10 entails dry pressing the well characterized ceramic or ceramic composite powder is mixed with a binder such as polyvinyl alcohol or poly ethylene glycol. The binder concentration is about 2 to 5 wt %, more specifically 3 wt %. The premixed (with binder) ceramic or ceramic composite powder is uniaxially pressed in a die and mold assembly specifically made to the shape and dimension of the molded ceramic part 10, taking into account the shape of the shrinkage during the sintering process. The pressure used in dry pressing of the molded ceramic part 10 is between 75 to 100 MPa, more specifically 100 MPa. The cold pressed "green" ceramic body is then ejected from the mold and sintered at a temperature of about 1300 to 1700° C. for 1 to 3 hours, more specifically 1500° C. for about 2 hours.

Figure 2:
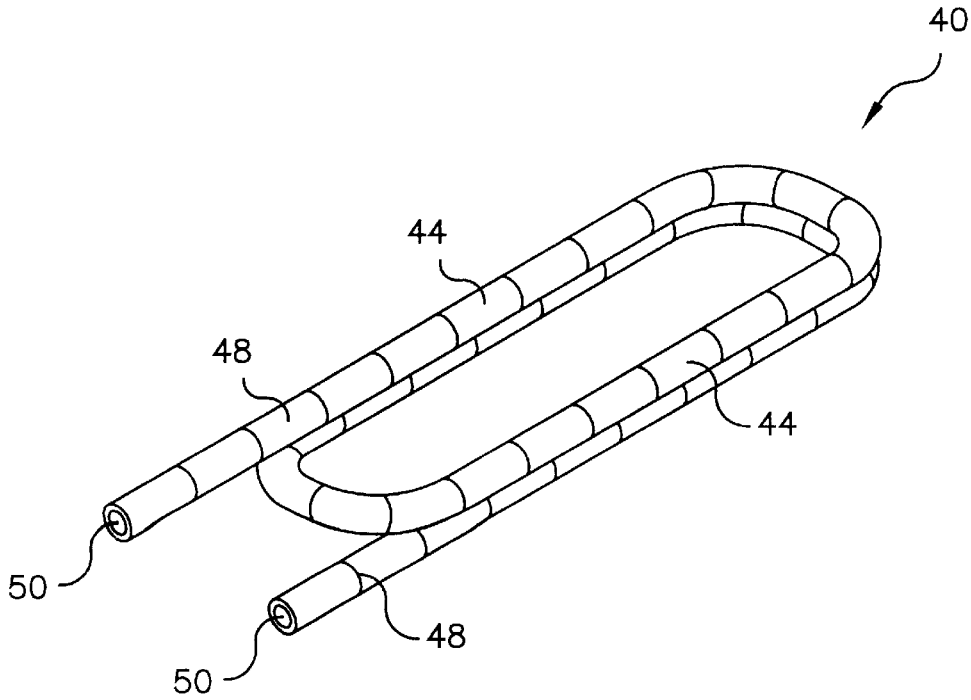
FIG. 2 is a perspective of an extruded ceramic conduit in the green state.

Referring to FIG. 2 a perspective is shown of a ceramic conduit structure 40 in the green state. The a ceramic conduit structure 40 comprises a conduit of ceramic material in a binder system which is formed in the shape of a coil. The ceramic conduit has a central portion 44, end portions 48 and an inner passage way 50. The a ceramic conduit structure 40 is made by extrusion process. The ceramic conduit structure 40 is designed to be large enough to compensate for the approximately 22% shrinkage of the ceramic conduit structure 40 which occurs during the sintering process. In the extrusion process, the appropriate ceramic or its composite powder is mixed with a suitable binder system. This ceramic compound is then forced through an extrusion dye and mandrel to form a hollow conduit in the green state.

The extrusion process consists of forcing a highly viscous, doughlike plastic mixture through a shaped die. Extrusion press for the ceramics and its composites can be of two types: one is an auger-type extruder in which the plasticized mixture of the powder with binder is forced through a shaped die by the rotation of an auger; the second type of extruder uses a piston in place of an auger. The piston-type extruder generally results in less contaminate by wear and is particularly suitable for extrusion of ceramic materials. In a specific case of the extrusion of alumina ceramic conduit, fine alumina particles (>1 $\mu$m) are mixed with the binder system. This is considered to be the most critical step in the extrusion process. All particles must be uniformly coated with the binder-liquid solution. Typical binders used for the extrusion process are hydroxyethyl cellulose or methylcelluite. Other additives in the binder system include lubricants, surfactants, dispersants, flocculants, plasticizers and such. The alumina-binder system mix is then extruded using a piston-type extruder. The extrusion die design can make provision for the conduit ID and OD. The extruded "green" ceramic conduit structure 40 is then slowly heated to a temperature of about 500° C. to remove the water and binder system before their densification by sintering at 1300–1700° C.

The configuration of the ceramic conduit structure 40 in the "green" state is determined by the desired shape of the coil. It is advisable and also appropriate to carefully bend the "green" extruded ceramic conduit structure 40 to the desired shape of the coil.

Figure 3:
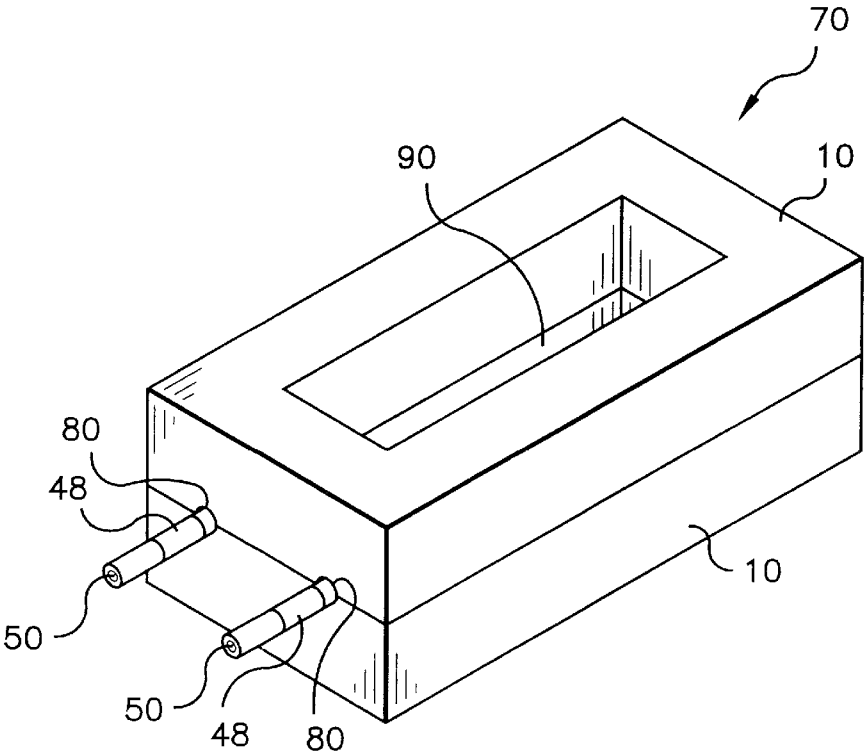
FIG. 3 is a perspective of an assembled coil receiving structure.

Referring to FIG. 3, a perspective is shown of an assembled coil receiving structure 70 comprising two molded ceramic parts 10 that are abutted to one another with their respective inner and outer ridges 34 and 36 (see FIG. 1) in contact with, and aligned with one another. The central portion 44 of ceramic conduit structure 40 is contained within the embedded cavity (not shown) formed by the joining of troughs 20 in the two molded ceramic parts 10. It is instructive to note that the troughs 20 of molded ceramic parts 10 are designed to be large enough to accommodate the central portion 44 of ceramic conduit structure 40 so that the central portion 44 of ceramic conduit structure 40 is not crushed or damaged during the sintering process. The end potions 48 of ceramic conduit structure 40 pass through holes 80 that are formed by the joining of outlet recesses 32 in the two molded ceramic parts 10. The assembled coil receiving structure 70 has a through-hole 90 that is formed by joining of through-holes 30 in the two molded ceramic parts 10. The assembled coil receiving structure 70 is sintered to form a unitary ceramic structure 100 with exposed sintered ceramic conduit end portions 110 and 120, and an internal passage way 130 (see FIG. 4) which takes the form of inner passage 50 of ceramic conduit structure 40 (see FIG. 2 and FIG. 3). The internal passage way 130 (see FIG. 4) has terminal openings (see FIG. 4) that pass through the exposed sintered ceramic conduit end portions 110 and 120. The internal passage way 130 provides an embedded coil receiving cavity in unitary ceramic structure 100.

Figure 4:
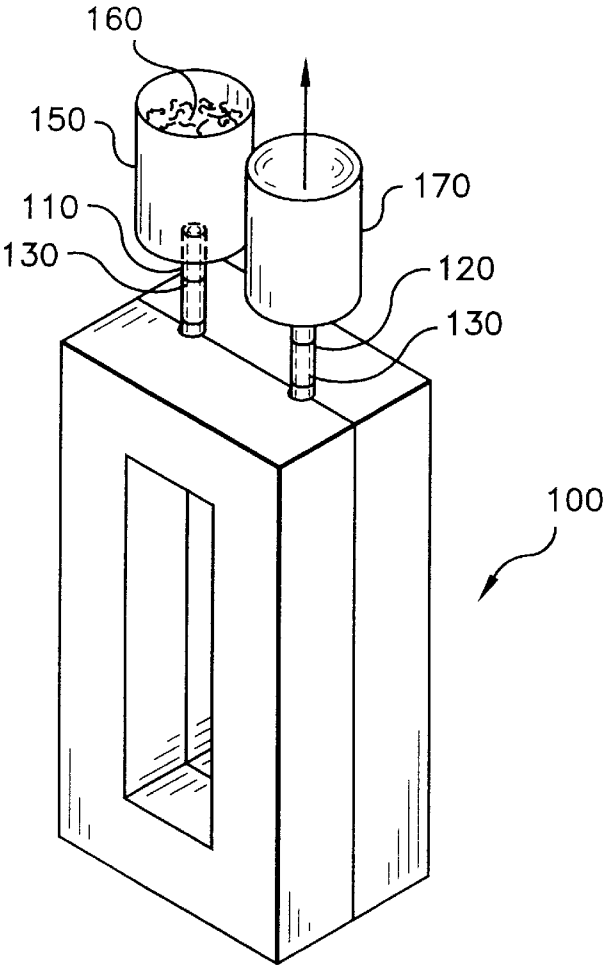
FIG. 4 shows the process of filling the internal passageway of the unitary ceramic structure with molten electrically conductive material.

Referring now to FIG. 4, the unitary ceramic structure 100 with internal passageway 130 is mounted in a vertical fashion with the sintered ceramic conduit end portion 110 surrounded by a nonporous container 150 which contains a molten pool of electrically conductive metal alloy 160 such as Au, Ag, Ag—Cu, or Cu—Sn. The sintered ceramic conduit end portion 120 is connected to a vacuum chamber 170 which is continually pumped so as to draw the molten electrically conductive metal alloy 160 through the internal passage way 130. In this way, the molten electrically conductive metal alloy 160 is made to the internal passage way 130 of unitary ceramic structure 100 thereby forming an embedded multi wound coil 180 (see FIG. 6*a*) in the unitary ceramic structure 100.

Figure 5:
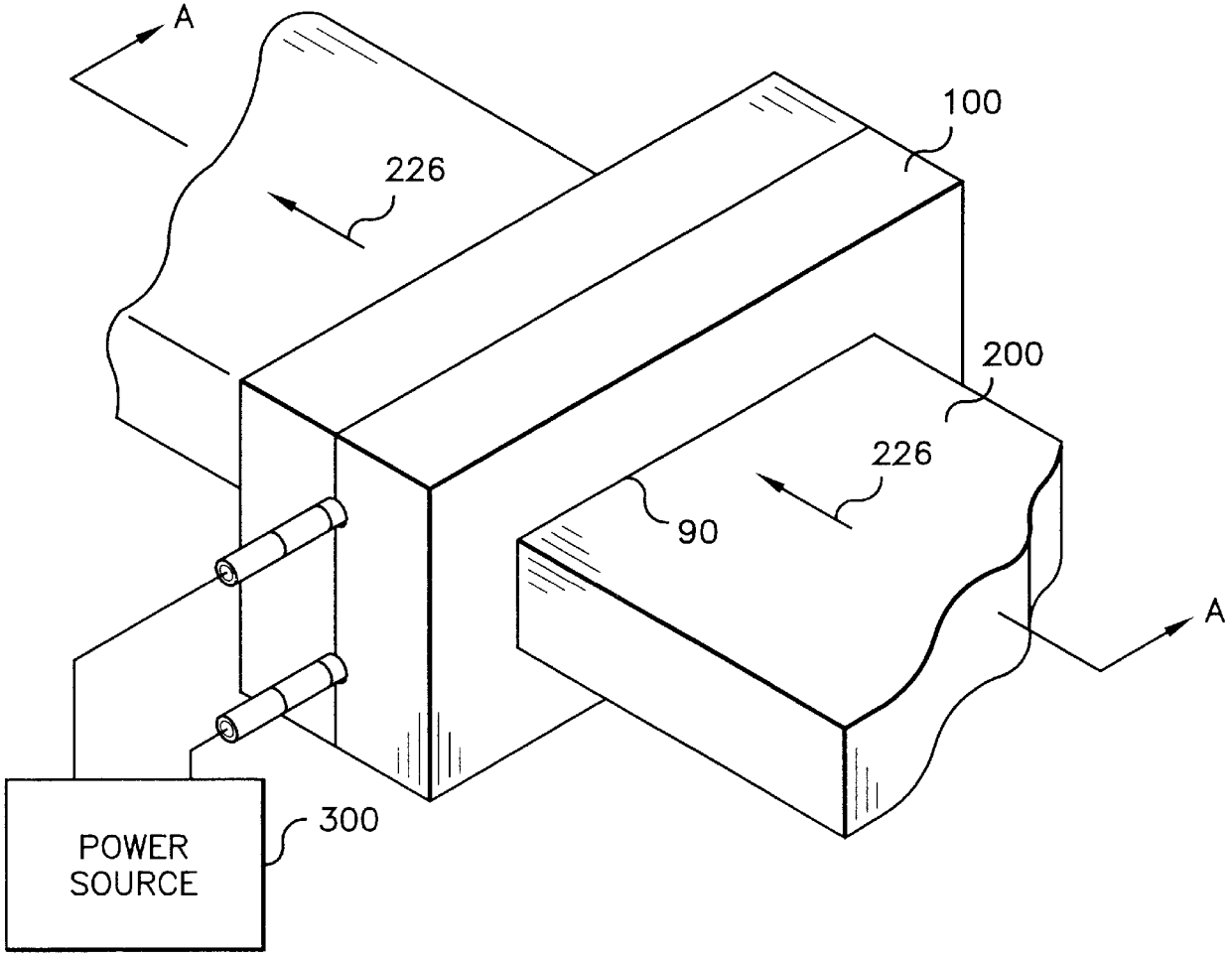
FIG. 5 is a perspective of the alignment process in which a magnetic film flows through the unitary ceramic structure with an energized embedded multiwound coil; and, FIG. 6*a* shows a cross-section of the energized embedded multiwound coil and magnetic alignment field taken along line A—A of FIG. 5; and, FIG. 6*b* shows an anisotropic magnetic particle.
Figure 6A:
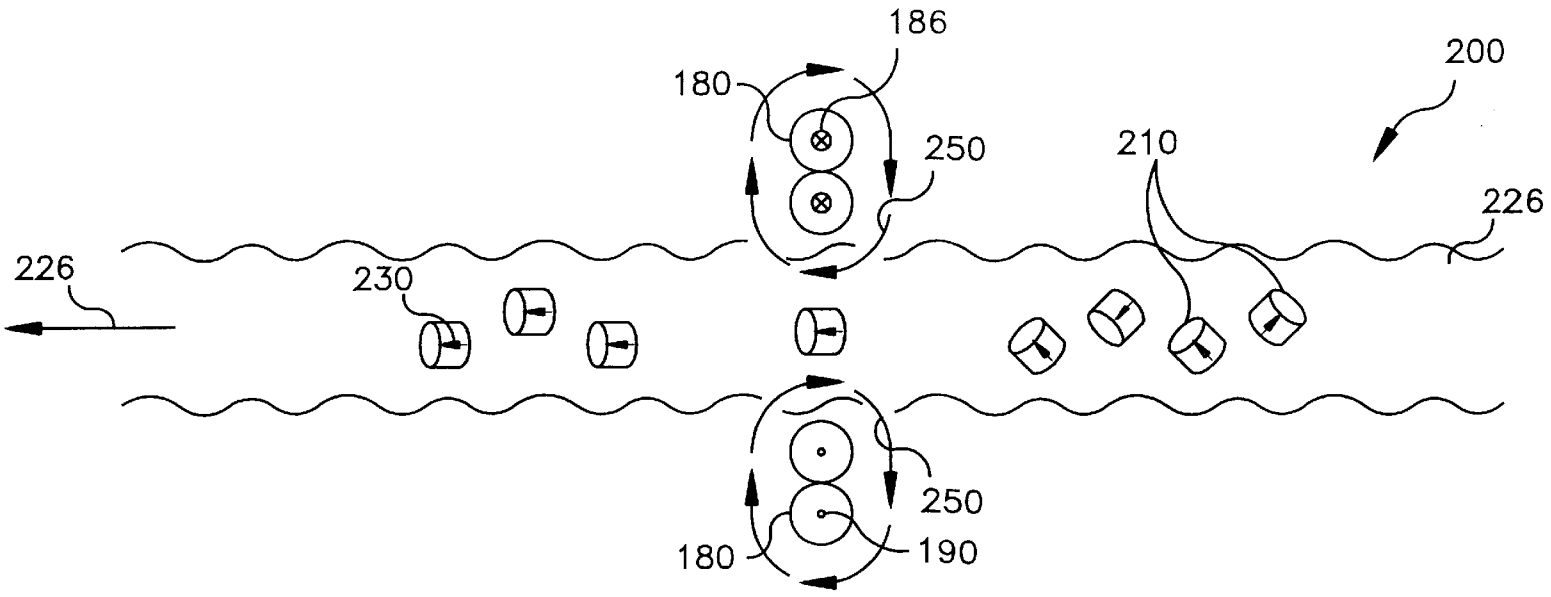
Figure 6B:
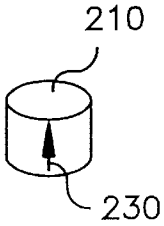

Referring now to FIGS. 5, 6*a* and 6*b*, the alignment of anisotropic magnetic particles in a viscous binder (prior to hardening of said binder) is shown. Specifically, a magnetic film 200 comprising anisotropic magnetic particles 210 (see FIG. 6) in a viscous binder 220 passes through the through-hole 90 of unitary ceramic structure 100 in the direction of flow arrows 226. The embedded multiwound coil 180 is attached to a power source 300 which causes current to flow through it. The flow of current through embedded multi-wound coil 180 is indicated by arrow tails 186 and arrow heads 190 (See FIG. 6*a*). Specifically the arrow tails 186 indicate that current flows into the page while the arrow heads 190 indicate that current flows out of the page as is well known. When current flows through embedded multi-wound coil 180 as indicated, a magnetic field 250 is produced as shown. The magnetic field permeates the through-hole 90 of unitary ceramic structure 100. Referring now to FIGS. 6*a* and 6*b*, the anisotropic magnetic particles 210 have a preferred axis of magnetization 230. During the alignment process, the magnetic field 250 of the coil 180 causes the anisotropic magnetic particles 210 to rotate in the viscous binder 220 so that their preferred magnetization axis 230 aligns with the magnetic field 250 as shown. In this way the anisotropic magnetic particles 210 arc aligned in the direction of flow of magnetic film 200. This will enhance the recording capability of magnetic film 200 when an external field is applied longitudinally to the magnetic film 200 as is well known.

The invention has been described with reference to a preferred embodiment. However, it will be appreciated that variations and modifications can be effected by a person of ordinary skill in the art without departing from the scope of the invention.

Part List

10 molded ceramic part
20 trough
30 through-hole
32 outlet recess
34 inner ridge
36 outer ridge
40 ceramic conduit structure
44 central portion
48 end portions
50 inner passage way
70 assembled coil receiving structure
80 outlet holes
90 through-hole
100 unitary ceramic structure
110 sintered ceramic conduit end portion
120 sintered ceramic conduit end portion
130 internal passageway
150 container
160 molten pool of electrically conductive material
170 vacuum chamber
180 embedded multiwound coil
186 arrow tail
190 arrow head
200 magnetic film
210 magnetic particles
220 viscous binder
226 flow arrows
230 preferred magnetization axis
300 power source

What is claimed is:

1. A method for forming a ceramic device having an embedded multiwound coil which is adapted for use in aligning magnetic particles provided in a viscous binder prior to hardening of such binder, comprising the steps of:

(a) providing at least two molded ceramic parts in the green state, each of which is formed with a trough and two spaced apart outlet recesses connected to different portions of the trough;

(b) providing through holes in each of the two molded ceramic parts;

(c) placing a green state ceramic conduit structure having an inner passageway into the trough of one of the molded ceramic parts with such conduit structure forming a coil structure;

(d) aligning the two molded ceramic parts to form a assembled coil receiving structure in which the troughs are aligned to encompass the conduit structure and the through holes are aligned to provide a passage for the viscous binder through the ceramic device;

(e) sintering the assembled coil receiving structure to form a unitary ceramic structure with an internal passageway in the form of the inner passage way of the green state ceramic conduit; and (f) filling the internal passageway of the unitary ceramic structure with an electrically conductive material to provide the embedded multiwound coil.

2. The method of claim 1 wherein the filling step includes drawing molten metal into the internal passage and cooling such molten metal to provide the embedded multiwound coil.

3. The method of claim 1 wherein the electrically conductive material is formed from conductive metal alloys including Au, Ag, Ag—Cu, or Cu—Sn.

4. The method of claim 1 wherein the molded ceramic parts in the green state are formed from alumina, titania, zirconia, boron nitride, magnesium oxide, alumina-zirconia composites, or zirconia-alumina composites.

5. The method of claim 1 wherein ceramic conduit in the green state is formed from alumina, zirconia, zirconia-alumina composites, or alumina-zirconia composites.

* * * * *